United States Patent [19]

Doring et al.

[11] 4,033,653

[45] July 5, 1977

[54] UNIVERSAL SPEAKER STAND

[75] Inventors: Lawrence C. Doring; Robert E. Williams, Jr., both of Memphis, Tenn.

[73] Assignee: Support Systems, Inc., Memphis, Tenn.

[22] Filed: Aug. 29, 1975

[21] Appl. No.: 609,084

[52] U.S. Cl. ..... 312/253; 248/172; 248/188; 248/188.1

[51] Int. Cl.[2] ..... A47B 91/00; F16M 11/38

[58] Field of Search ..... 179/1 E, 1 GA; 181/199; 248/13, 19, 23, 146, 149–151, 163, 165–167, 172, 188.1, 188.7, 173, 16, 188, 256–259, 269–272, 298; 312/195, 253, 255, 256

[56] References Cited

UNITED STATES PATENTS

| | | | |
|---|---|---|---|
| 1,209,388 | 12/1916 | Brown | 248/173 |
| 1,469,734 | 10/1923 | Staley | 248/185 X |
| 1,495,991 | 6/1924 | Drynan | 248/172 |
| 1,831,165 | 11/1931 | Eastman | 248/23 |
| 2,158,546 | 5/1939 | Lang et al. | 248/173 X |
| 2,364,855 | 12/1944 | Kampstad et al. | 248/23 |
| 2,400,224 | 5/1946 | Christensen et al. | 248/16 |
| 2,664,258 | 12/1953 | Lanier | 248/172 |
| 2,749,071 | 6/1956 | Remstein | 248/172 |
| 3,000,679 | 9/1961 | Silverman | 248/167 |
| 3,032,137 | 5/1962 | Rice | 181/199 |
| 3,385,929 | 5/1968 | Magyar et al. | 179/1 GA |
| 3,913,877 | 10/1975 | Wiener | 248/174 |
| 3,981,468 | 9/1976 | Holan | 248/167 |

FOREIGN PATENTS OR APPLICATIONS

| | | | |
|---|---|---|---|
| 1,263,846 | 3/1968 | Germany | 179/1 E |
| 1,177,790 | 9/1964 | Germany | 248/287 |
| 447,000 | 3/1949 | Italy | 248/23 |

*Primary Examiner*—Lawrence J. Staab
*Attorney, Agent, or Firm*—John R. Walker, III

[57] ABSTRACT

A speaker stand adaptable for selectively supporting different size speaker cabinets. The stand includes four legs respectively having horizontally extending arms which reach inwardly toward the middle of a horizontally disposed platelike member. In one embodiment the platelike member is provided with a group of circular apertures for each leg and wherewith the arms may be fixed to the platelike member at predetermined locations. In another embodiment the platelike member is provided with at least one elongated opening for each leg with an inverted tee shaped groove being provided along the length of each arm. The opening and the groove may be aligned one with the other for receiving a bolt fastener whereby the legs may be fixedly positioned at infinite spacings one from the other.

10 Claims, 6 Drawing Figures

UNIVERSAL SPEAKER STAND

BACKGROUND OF THE INVENTION

1. Field of the Invention

This invention relates to the field of stands for supporting stereo speaker cabinets.

2. Description of the Prior Art

Several stands of various configurations have heretofore been conceived and patented, many of which include adjustable means for varying the spaced apart distance between adjacent legs. However, none of these prior stands, racks, pallets, or the like known by the applicant suggest or disclose applicant's device. In fact, stands for stereo speakers are generally not available. A particular problem exists in attempting to develop a stand for stereo speaker cabinets. This problem stems from the fact that there are numerous different sizes and shapes of speaker cabinets on the market today. These speaker cabinets are generally identified as bookshelf speakers, i.e., the intent being to elevate them above the floor by placing them on a suitable bookshelf or the like. However, since bookshelves do not inherently exist in the typical home but must be purchased at a considerable cost, the general practice in placing home stereo speaker cabinets is to simply rest them on the floor. This practice not only results in the speakers being scratched and otherwise damaged but it also adversely affects the quality of the tone or sound coming from the speaker cabinet. This change in tone quality is caused by varying frequencies being coupled with the floor and becoming audibly altered in one or more ways. Additionally, the esthetic value of the speaker cabinet is adversely affected since it is a relatively small cabinet and resting it on the floor does not adequately present it in a prominent manner.

Since there are so many different sizes and shapes of speaker cabinets on the market, it would be extremely costly in constructing and warehousing an adequate inventory of custom fitted speaker stands. In other words, the ideal speaker stand would have the same other dimensions as does the speaker, i.e, the stand having the appearance of being an integral part of the speaker cabinet. Therefore, it can readily be appreciated that stands for stereo speaker cabinets or components are for the most part nonexistent or at least are too expensive to be widely accepted.

SUMMARY OF THE INVENTION

The present invention is directed towards overcoming the problems and disadvantages known to exist heretofore relative to speaker stands. The concept of the present invention is to provide a universal speaker stand adaptable for elevating any one of a variety of different size speaker cabinets to an optimum height above a supporting surface, i.e., particularly a floor. The stand, being somewhat like a stool, includes four uniform legs of predetermined length having horizontally extending arms permanently attached thereto and arranged with the arms reaching diagonally inwardly toward the middle of a horizontally disposed platelike member and having an overlapping engagement with each of the arms. In one embodiment the platelike member is provided with a group of circular apertures for each leg with the apertures being arranged in a fixed pattern commensurate with predetermined sizes or a family of the various sized speaker cabinets. Screw structure is utilized in this embodiment to hold the legs to the platelike member, i.e., these screws extend through at least one aperture in each respective group and threadedly engage the respective arm member, thus the arm members may be attached to the platelike member at various fixed locations commensurate with particular sizes of speaker cabinets.

In another embodiment the platelike member is provided with at least one elongated opening for each leg. Additionally, each arm is provided with an inverted tee shaped groove extending along the length thereof. In this embodiment, at least one nut and bolt is included to fasten each arm to the platelike member, i.e., the nut is trapped or is slidably received in a broad portion of the groove. The elongated opening and the tee shaped groove are adapted for alignment one with the other so as to simultaneously receive the bolt at any one point along the respective lengths thereof whereby each leg may selectively be fixedly positioned at any desirable location within a specified area. Thus, this latter embodiment provides infinite adjustability of the legs making the stand more universally adaptable to a larger family of speaker cabinets.

DESCRIPTION OF THE PREFERRED EMBODIMENT

Figure 1:
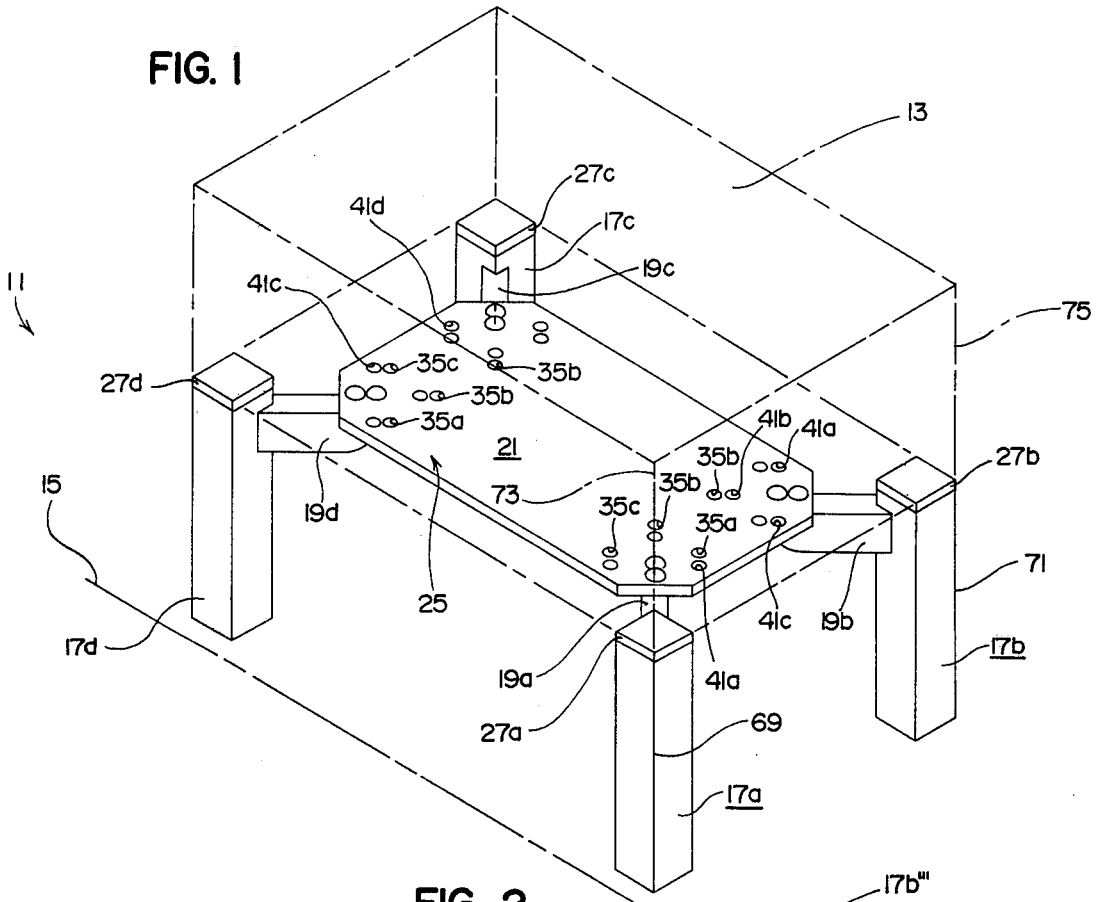
FIG. 1 is an isometric drawing of the principal embodiment of the instant universal speaker stand, showing a typical representation of a speaker cabinet in phantom lines restingly supported thereon.

The stand 11 of the present invention is adaptable for elevating any one of a variety of different size speaker cabinets characterized by the numeral 13 to an optimum height above a planar supporting surface, e.g., a floor characterized by the numeral 15. The stand 11 includes a plurality of upright uniform legs 17 (preferably four) which are individually designated as 17*a*, 17*b*, and 17*c*, etc., having predetermined lengths commensurate with the optimum height in which the speaker cabinet 13 is intended to be elevated about the floor 15. Each of the legs 17 includes a horizontally extending arm member 19 fixedly attached thereto, thus establishing a plurality of arm members 19 which are individually designated as 19*a*, 19*b*, and 19*c*, etc. From FIGS. 1 and 2 of the drawings it may readily be seen that the plurality of legs 17 are arranged with the arm members 19 reaching diagonally inwardly toward one another. Also included is a horizontally disposed platelike member 21 having respective peripheral portions as at 23 and which are individually designated as 23*a*, 23*b*, 23*c*, etc. The respective portions 23*a*, 23*b*, 23*c*, etc., conterminously engage the arm members 19*a*, 19*b*, 19*c*, etc., as indicated in FIGS. 2 and 3 of the drawings.

Figure 2:
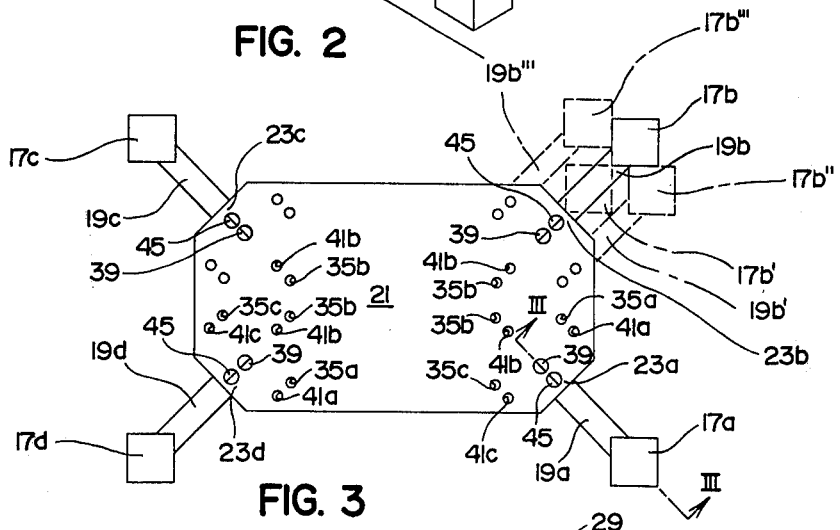
FIG. 2 is a top plan view of the speaker stand depicted in FIG. 1 with the upper right hand leg being shown in several different locations, thus typifying the concept herein disclosed.

Adjustable attachment means generally characterized by the numeral 25 are included for fixedly attaching each of the arm members 19 to the platelike member 21 at any one of several locations as clearly shown in FIG. 2 of the drawings. In other words, since the four corners of the speaker 13 are intended to be restingly supported by the upper ends of the legs 17 as clearly shown in FIG. 1 of the drawings, the stand 11 may selectively be configured for restingly supporting any one of a variety of different size speaker cabinets 13. It should be understood that the stand 11 depicted in FIGS. 1 through 3 of the drawings is intended to disclose the concept of the adjustable attachment means 25. More specifically, FIG. 2 shows the leg 17*b* in three alternate positions, i.e., 17*b*', 17*b*'', 17*b*''', while in actual practice it is the intention that the adjustable attachment means 25 (to be fully disclosed as the specification proceeds) enables the legs 17 to be fixed in numerous different locations.

Figure 3:
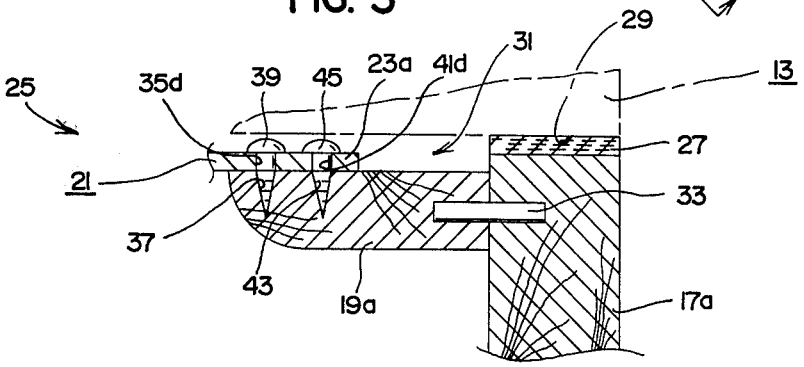
FIG. 3 is a sectional view taken as on the line III—III of FIG. 2 showing in phantom lines a portion of the speaker cabinet resting thereon.

From FIGS. 1 and 3 of the drawings it may clearly be seen that each of the legs 17 includes a horizontally disposed resilient pad member 27 which establishes an acme resting surface defining the upwardly directed surface of the leg 17 for restingly engaging a conterminous portion, as at 29 in FIG. 3, of the lowermost horizontal surface of the speaker cabinet 13. The platelike member 21 is straddled by the plurality of legs 17 and is disposed a predetermined distance below the resilient pad members 27*a*, 27*b*, 27*c*, 27*d* to establish a clearance 31 between the acme resting surface of each leg 17 and the remaining structure of the stand 11. The clearance 31 need only be of sufficient thickness to assure that the speaker cabinet 13 does not come in contact with any part of the stand 11 other than the pad members 27.

The arm members 19 are permanently attached to their respective leg 17 in any well known manner, as with dowel pins 33 or the like.

From FIGS. 1 through 3 of the drawings it may clearly be seen that the adjustable attachment means 25 includes providing the platelike member 21 with at least a primary group of circular apertures 35 which are individually designated as 35*a*, 35*b*, and 35*c*, etc., for each of the legs 17. In other words, the leg 17*a* has a primary group of apertures 35; the leg 17*b* has a primary group of apertures 35; the leg 17*c* has a primary group of apertures 35; and the leg 17*d* has a primary group of apertures 35. However, it should be understood that the primary group of apertures 35 preferably includes more than the four shown in the drawing, i.e., each aperture in each group being precisely positioned commensurate with the physical dimensions of a particular speaker cabinet 13. In other words, the primary group of circular apertures 35 are arranged in a predetermined pattern commensurate with predetermined sizes of a variety of different size speaker cabinets 13. The adjustable attachment means 25 also includes providing each of the arm members 19 with at least a primary bore, as clearly shown by the number 37 in FIG. 3 of the drawing. The bore 37 may selectively be aligned with any one of the circular apertures 35 in the primary group thereof. The adjustable attachment means 25 also includes at least primary fastener means or a screw 39 which extends through the aligned circular aperture 35 and the primary bore 37 for fixedly attaching the arm member 19 to the platelike member 21 in a manner as clearly shown in FIG. 3 of the drawings.

The adjustable attachment means 25 preferably includes providing each circular aperture 35*a*, 35*b*, 35*c*, etc., in the primary group of apertures with a companion circular aperture thus establishing a companion group of circular apertures 41 which are individually designated as 41*a*, 41*b*, and 41*c*, etc. From FIGS. 1 through 3 of the drawings it may clearly be seen that the companion group of circular apertures 41 respectively are arranged at specified uniform distances from the primary group of circular apertures 35. Additionally, each arm member 19 is provided with a companion bore 43 with the primary and companion bores 37, 43 having the same specified spaced apart distance as each set of primary and companion circular apertures 35*a*, 41 respectively. Further, the companion bore 43 is selectively and cooperatively aligned with any one of the companion circular apertures 41, e.g., the companion aperture 41*d* as shown in FIG. 3 of the drawings. The attachment means 25 also includes second fastener means or a screw 45 extending through the aligned companion circular aperture 41 and companion bore 43 for more securely attaching the arm member 19 to the platelike member 21. It should be understood that the platelike member 21 may be in any form, e.g., rectangular, triangular, cruciform, circular, octagon, etc., without departing from the spirit and scope of the present invention. Obviously, the length and width of the platelike member 21 determines the minimum and maximum overall width and length of the assembled stand 11. Therefore, one size of platelike member 21 will accomodate a first family of different size speaker cabinet 13 while a different size platelike member 21 will accomodate a second family of speaker cabinets 13, etc.

DESCRIPTION OF THE ALTERNATE EMBODIMENT

Figure 4:
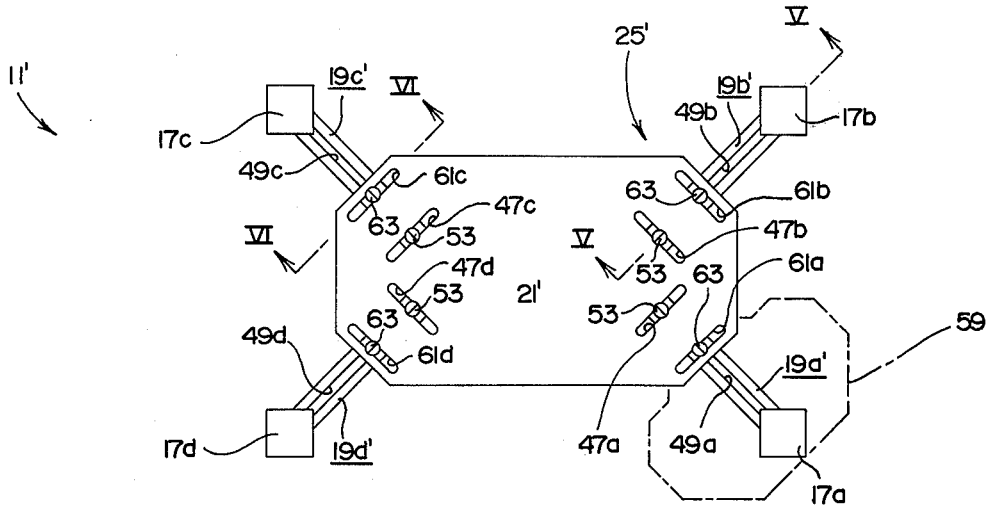
FIG. 4 is a top plan view of an alternate embodiment of the speaker stand of the present invention, an area is shown about the lower right hand leg to illustrate the infinite adjustability of all the legs.

The stand 11' of the present invention is clearly shown in FIG. 4 of the drawings and since the stand 11' is very similar to the above described stand 11, the following disclosure will primarily be directed towards the difference between the two concepts. The difference for the most part involves the adjustable attachment means 25, 25', and the arm members 19, 19'. More specifically, the adjustable attachment means 25' includes providing the platelike member 21' with at least a primary elongated opening or slot 47 for each of the legs 17 thus establishing a plurality of openings 47 which are individually designated as 47*a*, 47*b* and 47*c*, etc. From FIG. 4 of the drawings it may clearly be seen that each of the elongated primary openings 47, e.g., the primary opening 47*c*, has the longitudinal axis thereof extending substantially perpendicular with the major axis of the arm member 19, i.e., the arm member 19*c*.

Figure 5:
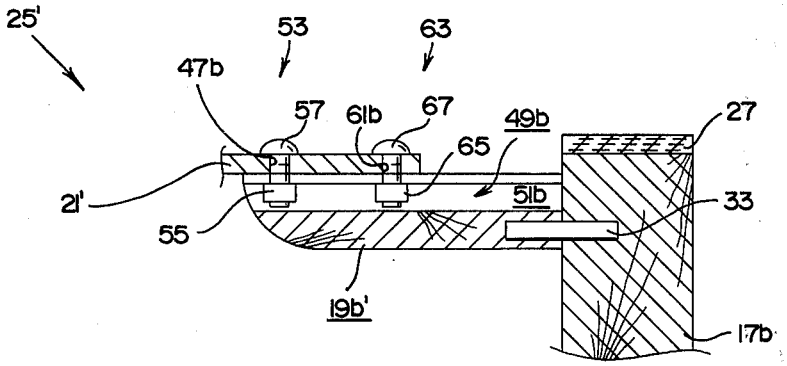
FIG. 5 is a sectional view taken as on the line V—V of FIG. 4.
Figure 6:
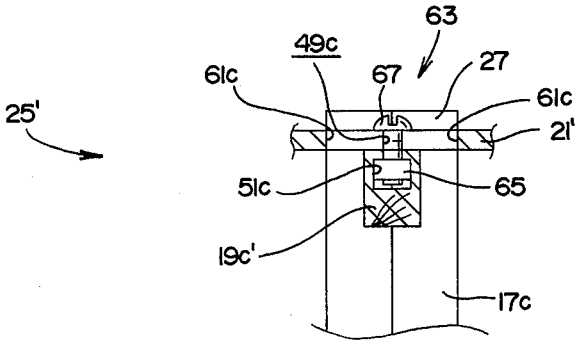
FIG. 6 is a sectional view taken as on the line VI—VI of FIG. 4.

Additionally, each of the arm members, e.g., the arm member 19*c*, is provided with an elongated inverted T-shaped groove 49 extending substantially along the length thereof for cooperative substantially perpendicular alignment with the primary elongated opening 47*c*, thus establishing a plurality of grooves 49 which are individually designated as 49*a*, 49*b*, and 49*c*, etc., and as clearly shown in FIGS. 4 through 6 of the drawings. Each of the T-shaped grooves, e.g., the groove 49*c*, has an elongated broad lower portion as at 51*c* in FIG. 6 of the drawings.

The adjustable attachment means 25' includes at least primary fastener means 53 including a first nut member 55 for each arm member 19, e.g., the arm **19*b*, slidably received in the broad lower portion 51 and a first bolt member 57 for each nut member 55 with the bolt member 57 extending through the primary elongated opening, e.g., the opening 47*b*, and the T-shaped groove, e.g., the T-shaped groove 49*b*. The first bolt member 57 is threadedly engaged with the first nut member 55 for fixedly attaching the arm member 19*b'* to the platelike member 21' selectively at any one of infinite locations. The primary elongated opening 47 and the T-shaped groove 49 are adapted for alignment to simultaneously receive the first bolt member 57 substantially at any point along the respective lengths thereof whereby each of the legs, e.g., the leg 17*a*, FIG. 4, may selectively be positioned at any desirable location within a specified area, the area being shown in broken lines and characterized by the numeral 59**.

The adjustable attachment means 25' preferably includes providing each of the primary elongated openings 47 with a companion elongated opening thus establishing a plurality of companion elongated openings or slots 61 which are individually designated as **61*a*, 61*b* and 61*c*, etc., for cooperative substantially perpendicular alignment with the appropriate T-shaped groove 49. From FIG. 4 of the drawings it may clearly be seen that the primary and companion elongated opening or slots 47, 61 are substantially parallel one with the other. Further, the adjustable attachment means 25' includes companion fastener means generally characterized by the numeral 63 and including a second nut member 65 for each arm member, e.g., the arm member 19*c'* shown in FIG. 6 of the drawings, slidably received in the appropriate broad lower portion 51 and a second bolt member 67 for each of the second nut members 65. The second bolt member 67 extends through the companion elongated opening 61*c* and the T-shaped groove 49*c* with the bolt member 67 threadedly engaging the nut member 65 for more securely attaching the arm member 19*c'* to the platelike member 21' selectively at any one of infinite locations. The companion elongated openings 61 and the T-shaped grooves 49 are adapted for alignment to simultaneously receive the second bolt member 67 substantially at any point along the respective lengths thereof whereby each of the legs, e.g., the leg 17*a*, may selectively be positioned at any desirable location within the specified area 59**.

From the foregoing it will be seen that I am enabled to secure several advantages in connection with the two embodiments of the stand 11. An important feature of the present invention is that the speaker 13 rests on the legs 17 or more specifically on the resilient pad members 27 defining the upper ends of the legs 17, i.e., the weight of the speaker cabinet 13 bears parallel with the respective elongated axes of the legs 17. Therefore, there is little stress exerted on the adjustable attachment means 25, 25'. Another important feature of the present invention is that the arm members 19, 19' reach predetermined distances diagonally inwardly toward one another below the speaker cabinet 13 thus providing considerable rigidity to the stand 11. Another important feature of the present invention is that the adjustable attachment means 25, 25' attaches the respective arm members 19, 19' to the appropriate platelike member 21, 21' at any one of several different locations whereby the respective outer edges, e.g., the edges 69, 71 for the respective legs **17*a*, 17*b*, may be aligned with the plurality of vertically extending externally disposed corner edges, e.g., the edges 73, 75 of the speaker cabinet 13 regardless of the variations in size of the speaker cabinet, i.e., within predetermined limits of the size of the platelike member 21, 21'. Although applicant does not intend the legs 17 be limited to being square in cross-section, i.e., the legs 17** may take on any cross-sectional shape, such as being round, without departing from the intent of this invention.

Although the invention has been described and illustrated with respect to preferred embodiments thereof, it is to be understood that it is not to be so limited since changes and modifications may be made therein which are within the full intended scope of the invention.

We claim:

1. A stand adaptable for elevating any one of a variety of different size speaker cabinets to an optimum height above a planar supporting surface, said stand comprising a plurality of upright uniform legs having predetermined lengths commensurate with the optimum height in which the speaker cabinet is intended to be elevated above the planar supporting surface, each of said legs including a horizontally extending arm member fixedly attached thereto, said plurality of legs being arranged with said arm members thereof reaching inwardly toward one another, a horizontally disposed member engaging said arm members, each of said legs including a horizontally disposed means to establish an acme resting surface defining the upwardly directed surface of said leg for restingly engaging in a conterminous portion of the lowermost horizontal surface of the speaker cabinet, and adjustable attachment means for attaching each of said arm members to said horizontally disposed member at any one of several different locations, said adjustable attachment means including means for selectively positioning each of said legs inwardly generally towards the other of said legs and outwardly generally away from the other of said legs and for selectively positioning each of said legs in one of a plurality of positions with each of said horizontally extending arm members extending outward of said horizontally disposed member at the same angle relative to the other arm member in each of the plurality of positions and with the distance between any adjacent pair of legs being variable independently of the distance between any other adjacent pair of legs for placement of said legs in at least several positions to enable said plurality of legs to restingly support any one of a variety of speaker cabinets of different widths and legths of said lowermost horizontal surface thereof.

2. The stand as set forth in claim 1 in which said adjustable attachment means includes providing said platelike member with at least a primary group of circular apertures for each of said legs, said primary group of circular apertures being arranged in a predetermined pattern commensurate with predetermined sizes of a variety of different size speaker cabinets, each of said arm members being provided with at least a primary bore which may selectively be aligned with any one of said circular apertures in said primary group thereof, and at least primary fastener means extending through said aligned circular aperture and said primary bore for fixedly attaching said arm member to said platelike member.

3. The stand as set forth in claim 2 in which said adjustable attachment means includes providing each circular aperture in said primary group of apertures with a companion circular aperture thus establishing a companion group of circular apertures in said platelike member, said companion group of circular apertures respectively being arranged at specified uniform distances from said primary group of circular apertures, each of said arm members being provided with a companion bore with said primary and companion bores having the same specified spaced apart distance as each set of primary and companion circular apertures respectively, said companion bore being selectively and cooperatively aligned with any one of said companion circular apertures, and second fastener means extending through said aligned companion circular aperture and companion bore for more securely attaching said arm member to said platelike member.

4. The stand as set forth in claim 1 in which said horizontally disposed member is platelike and is provided with sides and with peripheral portions and in which said adjustable attachment means includes providing said horizontally disposed member with a least a primary elongated opening for each of said legs, each of said elongated primary openings being disposed adjacent said peripheral portions and having the longitudinal axis thereof extending diagonal with respect to the sides of said horizontally disposed member, each of said arm members being provided with an elongated inverted tee shaped groove extending substantially along the length thereof for cooperative substantially perpendicular alignment with said primary elongated opening, each of said tee shaped grooves having an elongated broad lower portion, and at least primary fastener means including a first nut member for each arm member slidably received in said broad lower portion of said tee shaped groove thereof and a first bolt member for each of said first nut members extending through said primary elongated opening and said tee shaped groove and being threadedly engaged with said first nut member for fixedly attaching said arm member to said horizontally disposed member selectively at any one of infinite locations, said primary elongated opening and said tee shaped groove being adapted for alignment to simultaneously receive said first bolt member substantially at any point along the respective lengths thereof whereby each of said legs may selectively be fixedly positioned at any desirable location within a specified area.

5. The stand as set forth in claim 4 in which said adjustable attachment means includes providing each of said primary elongated openings with a companion elongated opening for cooperative substantially perpendicular alignment with said appropriate tee shaped groove, said primary and companion elongated openings being substantially parallel one with the other, and companion fastener means including a second nut member for each arm member slidably received in said appropriate broad lower portion of said tee shaped groove and a second bolt member for each of said second nut members extending through said companion elongated opening and said tee shaped groove and being threadedly engaged with said second nut member for more securely attaching said arm member to said platelike member selectively at any one of inifinite locations, said companion elongated opening and said tee shaped groove being adapted for alignment to simultaneously receive said second bolt member substantially at any point along the respective lengths thereof whereby each of said legs may selectively be positioned at any desirable location within a specified area.

6. The combination with one of a variety of different size speaker cabinets each having a plurality of vertically extending externally disposed corner edges, of a stand restingly supporting the selected speaker cabinet at an optimum height above a planar supporting surface, said stand comprising a plurality of upright uniform legs having predetermined lengths commensurate with the optimum height in which said speaker cabinet is intended to be elevated above the planar supporting surface, said plurality of legs respectively including a plurality of horizontally extending arm members fixedly attached thereto and reaching predetermined distances inwardly toward one another below said speaker cabinet, a horizontally disposed planar platelike member having respective peripheral portions thereof conterminously engaging said arm members, a plurality of pad members interposed between each of said legs and said speaker cabinet, said pad members establishing a plurality of acme resting surfaces defining the upwardly directed surfaces of said plurality of legs and which restingly engage a plurality of conterminous portions of the lowermost horizontal surface of the speaker thus providing a degree of stability of said speaker cabinet as said speaker cabinet is restingly supported thereon, and adjustable attachment means for attaching each of said arm members to said platelike member at any one of several different locations, said adjustable attachment means including means for selectively positioning each of said horizontally extending arm members outward of said platelike member st the same angle relative to the other arm members in each of the several different locations with the distance between any adjacent pair of legs being variable independently of the distance between any other adjacent pair of legs for placement of said legs in at least several positions to enable said plurality of legs to restingly support any one of a variety of different size speakers in such a manner that the respective outer edges of said plurality of legs may be aligned with the plurality of vertically extending externally disposed corner edges of said selected speaker cabinet, irrespectively of any variance within reasonable limits in either the width or length of said lowermost horizontal surface thereof.

7. The combination as set forth in claim 6 in which said adjustable attachment means includes providing said platelike member with at least a primary group of circular apertures for each of said legs, said primary group of circular apertures being arranged in a predetermined pattern commensurate with predetermined sizes of a variety of different size speaker cabinets, each of said arm members being provided with at least a primary bore which may selectively be aligned with any one of said circular apertures is said primary group thereof, and at least primary fastener means extending through said aligned circular aperture and said primary bore for fixedly attaching said arm member to said platelike member.

8. The combination as set forth in claim 7 in which said adjustable attachment means includes providing each circular aperture in said primary group of apertures with a companion circular aperture thus establishing a companion group of circular apertures in said platelike member, said companion group of circular apertures respectively being arranged at specified uniform distances from said primary group of circular apertures, each of said arm members being provided with a companion bore with said primary and companion bores having the same specified spaced apart distance as each set of primary and companion circular apertures respectively, said companion bore being selectively and cooperatively aligned with any one of said companion circular apertures, and second fastener means extending through said aligned companion circular aperture and companion bore for more securely attaching said arm member to said platelike member.

9. The combination as set forth in claim 6 in which said platelike member includes sides and in which said adjustable attachment means includes providing said platelike member with at least a primary elongated opening for each of said legs, each of said elongated primary openings being disposed adjacent said peripheral portions and having the longitudinal axis thereof extending diagonal with respect to the sides of said platelike member, each of said arm members being provided with an elongated inverted tee shaped groove extending substantially along the length thereof for cooperative substantially perpendicular alignment with said primary elongated opening, each of said tee shaped grooves having an elongated broad lower portion, and at least primary fastener means including a first nut member for each arm member slidably received in said broad lower portion of said tee shaped groove thereof and a first bolt member for each of said first nut members extending through said primary elongated opening and said tee shaped groove and being threadedly engaged with said first nut member for fixedly attaching said arm member to said platelike member selectively at any one of infinite locations, said primary elongated opening and said tee shaped groove being adapted for alignment to simultaneously receive said first bolt member substantially at any point along the respective lengths thereof whereby each of said legs may selectively be fixedly positioned at any desirable location within a specified area.

10. The combination as set forth in claim 9 in which said adjustable attachment means includes providing each of said primary elongated openings with a companion elongated opening for cooperative substantially perpendicular alignment with said appropriate tee shaped groove, said primary and companion elongated openings being substantially parallel one with the other, and companion fastener means including a second nut member for each arm member slidably received in said appropriate broad lower portion of said tee shaped groove and a second bolt member for each of said second nut members extending through said companion elongated opening and said tee shaped groove and being threadedly engaged with said second nut member for more securely attaching said arm member to said platelike member selectively at any one of infinite locations, said companion elongated opening and said tee shaped grovve being adapted for alignment to simultaneously receive said second bolt member substantially at any point along the respective lengths thereof whereby each of said legs may selectively be positioned at any desirable location within a specific area.

* * * * *